US005307778A

United States Patent [19]

Hummel et al.

[11] Patent Number: 5,307,778

[45] Date of Patent: May 3, 1994

[54] FUEL INJECTION PUMP FOR INTERNAL COMBUSTION ENGINES

[75] Inventors: Karsten Hummel, Beilstein-Schmidhausen; Karl Rapp; Hansjoerg Frey, both of Stuttgart, all of Fed. Rep. of Germany

[73] Assignee: Robert Bosch GmbH, Stuttgart, Fed. Rep. of Germany

[21] Appl. No.: 60,623

[22] Filed: May 14, 1993

[30] Foreign Application Priority Data

Aug. 22, 1992 [DE] Fed. Rep. of Germany ..... 4227854

[51] Int. Cl.[5] ..... F02M 37/04

[52] U.S. Cl. ..... 123/495

[58] Field of Search ..... 123/495, 500, 501, 90.48

[56] References Cited

U.S. PATENT DOCUMENTS

| | | | |
|---|---|---|---|
| 3,977,370 | 8/1976 | Humphreys | 123/90.48 |
| 4,167,926 | 9/1979 | Leblanc et al. | 123/495 |
| 4,617,903 | 10/1986 | Heberle et al. | 123/501 |
| 4,842,497 | 6/1989 | Hafele et al. | 123/495 |
| 5,022,356 | 6/1991 | Morel, Jr. et al. | 123/90.48 |

FOREIGN PATENT DOCUMENTS 3840022 5/1990 Fed. Rep. of Germany .

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A fuel injection pump for internal combustion engines, having a pump piston that is axially guided in a cylinder bushing which defines a pump work chamber there and is moved axially by a cam drive counter to the force of a restoring spring. The cam drive comprises a roller tappet connected to the pump piston whose roller rolls off on a cam of a camshaft driven by the internal combustion engine to be supplied. In the process, the roller is connected to the cylindrical part of the roller tappet by means of a roller pin disposed vertically to the axis of the roller tappet. This roller pin is axially secured by means of the contact of its axial ends to the wall of a bore that guides the roller tappet, for which purpose the transition area between the face ends, which extend vertically to the axis of the roller pin, and the circumferential area of the roller pin is part of a circular ring. The radius of the circular ring cross-section is adapted to the diameter of the wall of the roller tappet guide.

3 Claims, 2 Drawing Sheets

FUEL INJECTION PUMP FOR INTERNAL COMBUSTION ENGINES

FIELD OF THE INVENTION

The invention is based on a fuel injection pump as defined hereinafter. In a fuel injection pump known from DE-OS 38 40 022, a pump piston that is guided in a cylinder bushing and defines a pump work chamber with its face end moved axially by a cam drive counter to the force of a return spring. The pump piston communicates at its end remote from the pump work chamber with a roller tappet whose roller runs on a cam race of a cam disposed on a camshaft that is driven by the engine to be supplied. The roller tappet that communicates with the pump piston has a cylindrical element that acts as a slide apron, and with which the roller tappet is guided axially in a housing bore of the fuel injection pump. The roller disposed inside the roller tappet and protruding from its end remote from the pump piston is thus connected with the slide apron of the roller tappet via a roller pin disposed crosswise to the axis of the roller tappet, and this roller pin is guided in a radial through bore of the slide apron and secured axially by means of its ends being in contact with the wall of the housing bore that guides the roller tappet. The roller pin has a plurality of peripheral annular grooves for lubrication to reduce friction; by means of these grooves, a lubricant can reach the gliding surfaces between the roller pin and the gliding sleeve of the roller tappet or roller.

The known fuel injection pump has the disadvantage that, because of the cuts for the lubrication grooves, the cross-section of the roller pin frequently weakens and, consequently, pin breaks occur, starting at the annular grooves. Moreover, in these known fuel injection pumps, no particular axial securing of the roller on the roller pin is provided, so that the roller can come in contact with the surface of the inner wall of the slide apron during operation, which again results in increased wear at this point.

OBJECT AND SUMMARY OF THE INVENTION

In contrast thereto, the fuel injection pump in accordance with the invention has an advantage that by means of the design of the bearing shells that guide the roller pin in the housing of the roller tappet as being open in the direction of the cam drive, it is possible to insert the roller pin from the side of the roller tappet facing the cam drive, which permits pre-assembly of the roller on the roller pin. The roller can thus be secured axially in its position on the roller pin by means of a press fitting, which prevents the roller from knocking against the inner wall of the roller tappet. A further advantage is provided by the design in accordance with the invention of the axial ends of the roller pin, where the edges between the axial face ends and the circumferential area are embodied as part of a circular ring that is adapted to the contour of the cross-sectional area of the circular ring of the inner wall area of the housing bore that guides the roller tappet, so that the roller pin is axially secured without additional securing elements.

To avoid increased friction of the roller pin in the guidance of the roller tappet, the roller pin is bronzed so that lubrication grooves on the roller pin as well as on the roller tappet can thus be eliminated, and because of the open design of the roller pin bearing in the roller tappet, it is possible to omit a bushing that guides the roller pin.

The invention will be better understood and further objects and advantages thereof will become more apparent from the ensuing detailed description of the preferred embodiment taken in conjunction with the drawings.

BRIEF DESCRIPTION OF THE PREFERRED EMBODIMENT

Figure 1:
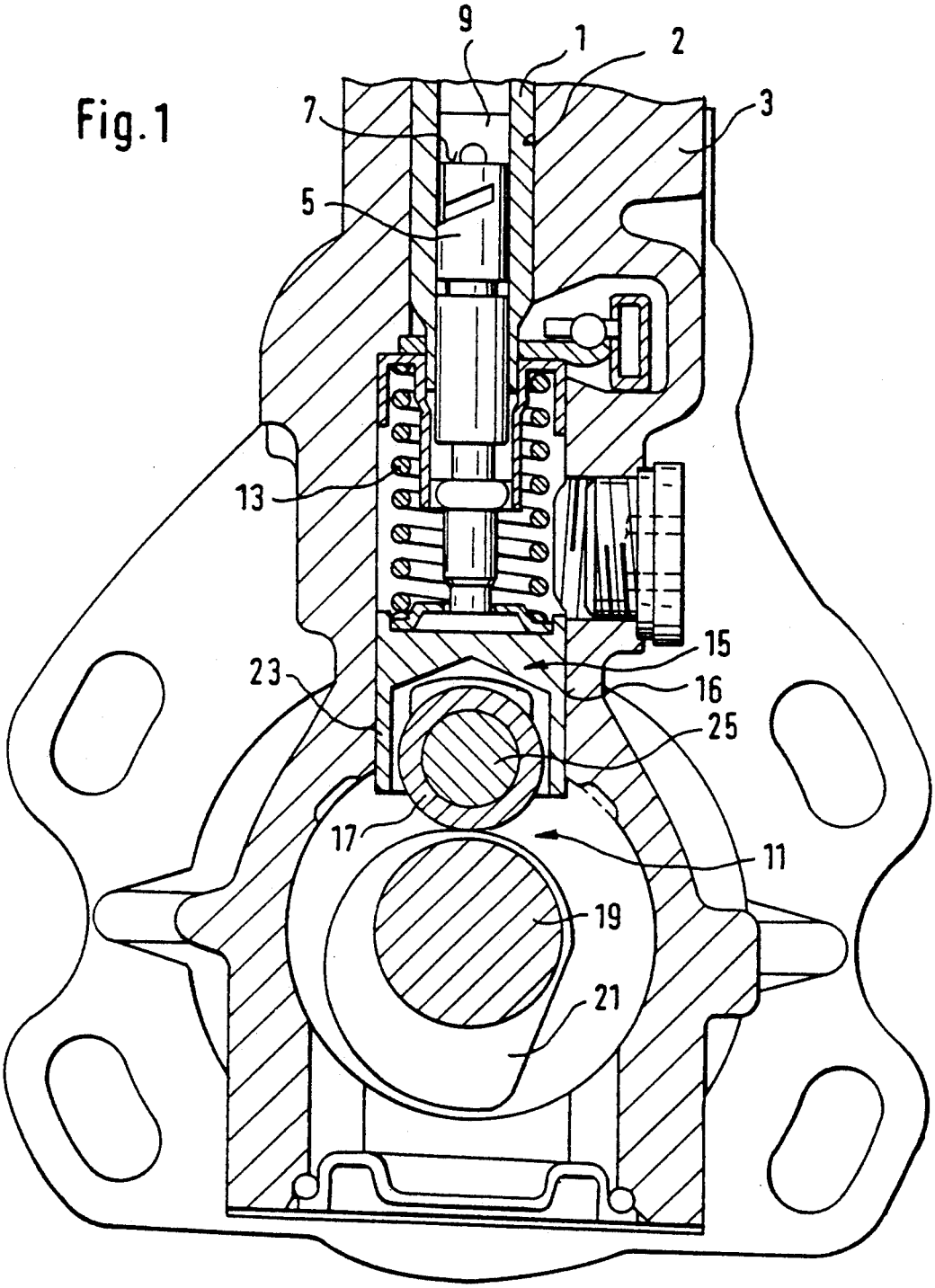
FIG. 1 shows a view of the fuel injection pump in accordance with the invention.

The description of the fuel injection pump shown in detail in FIG. 1 is limited to the components that are essential to the invention or that are adjacent to them. A cylinder bushing 1 is inserted into a bore 2 of a pump housing 3, in which a pump piston 5 that defines a pump work chamber 9 in the cylinder bushing 1 with its face end 7 is guided axially. A cam drive 11 moves the pump piston 5 axially counter to the force of a restoring spring 13 in the direction of the pump work chamber 9, for which purpose the pump piston 5 is connected at its end remote from the pump work chamber to a roller tappet 15 that rolls off with a roller 17 on the cam race of a cam 21 disposed on a camshaft 19 that is driven by the internal combustion engine to be supplied and that is guided axially in a further part of the housing bore 2, whose enlarged diameter is embodied as a roller tappet guide 16.

In this case the roller 17 is connected to the roller tappet 15 via a roller pin 25 that is disposed crosswise to the axis of the cylindrical element of the roller tappet 15 embodied as a slide apron 23, and guided in a bearing shell 27 from FIG. 1, not shown, of the slide apron 23.

Figure 2:
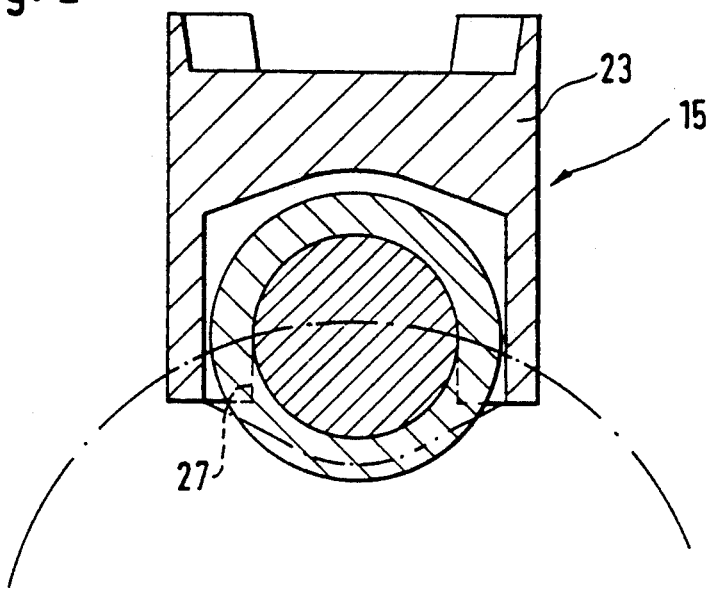
FIG. 2 shows an enlarged view of the arrangement of the roller pin in the roller tappet from FIG. 1.
Figure 3:
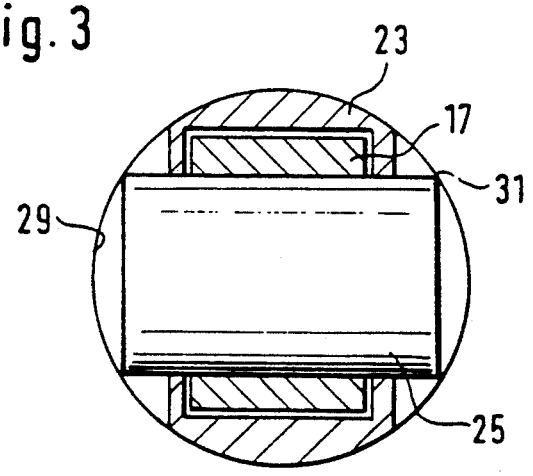
FIG. 3 shows a section through FIG. 2, in which the roller pin is represented in a second view.

The design of the roller pin 25 and its hinging to the slide apron 23 of the roller pin 15 is shown enlarged and in two views in FIGS. 2 and 3.

FIG. 2 shows a longitudinal section through the lower part of the roller tappet 15. The cylinder-shaped slide apron 23 guided axially in the roller tappet guide 16 has a bearing shell 27 open in the direction toward the cam drive 11, which is shown in FIG. 2 in dashed lines as a covered edge of a body. This bearing shell 27, open in the direction of the cam 21 and U-shaped, guides the roller pin 25 crosswise and axially, the roller pin 25 being held in contact by the cam 21 at the upper end of the bearing shell 27 via the roller 17 disposed on it. The roller 17 applied to the roller pin 25 by means of a press fitting protrudes on the side remote from the cam 21 beyond its center axis into the inner part of the slide apron 23, and the inner wall area 29 of the roller tappet guide 16 is dimensioned such that the roller 17 does not knock against it. The roller pin 25, whose circumferential area is ground smooth and bronzed, is axially secured by means of the contact of its axial ends with the inner wall area 29 of the roller tappet guide 16, as shown in FIG. 3. For this purpose the transition area 31 between the circumferential area of the roller pin 25 and the face ends of its axial ends forms part of an enveloping curve that is adapted to the cylindrical contour of the inner wall area 29 of the part of the housing bore 2 that forms the roller tappet guide 16, and whose radius has the same center as the radius of the roller tappet guide 16.

With its rounded-off transitions area 31, the roller pin 25 forms an extension, at the axial face ends, of the outer diameter of the slide apron 23 of the roller tappet 25, which in the exit area of the roller pin 25 deviates from the cylindrical shape because of a flattening and slides by means of this transition area 31 in the roller tappet guide 16.

It is therefore possible with the described embodiment of the roller pin to eliminate recesses for axially securing the roller pin in the roller tappet 15 that weaken the cross-section of the roller pin 25, without creating a negative effect on capability. Since pre-assembly of the roller 17 on the roller pin 25 is possible because of the roller tappet guide 27 that is open in the direction of the cam 21, the roller can be secured by means of a press fitting onto the roller pin, so that additional securing measures can also be eliminated there.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having a cylinder bushing (1) inserted into a housing bore (2), in which a pump piston (5) is axially guided, said pump piston defines a pump work chamber (9) in the cylinder bushing (1) by means of a face end (7) and is moved axially back and forth by a cam drive (11) against a force of a restoring spring (13), a roller tappet (15) includes a roller (17) connected to the pump piston (5) via a roller pin (25) disposed crosswise to an axis of a cylinder-shaped housing of the roller tappet (15) in which said cylinder-shaped housing is embodied as a slide apron (23), the roller (17) rolls on the race of a cam (21) of a camshaft (19) driven by the internal combustion engine; the roller pin (25) is axially secured by means of a contact of its axial ends with an interior wall (29) of a part (16) of the housing bore (2) which guides the roller tappet (15), the roller pin (25) is guided in a bearing shell (27), open in a direction toward the cam drive (11), in the cylinder-shaped housing (23) of the roller tappet (15) and the axial ends of the roller pin (25) are embodied as flat surfaces extending vertically to the axis of the roller pin (25) which form transition areas (31) towards a circumferential surface, the transition areas (31) form a part of a generated enveloping curve that is adapted to a cylindrical contour of the interior wall area (29) that forms the roller tappet guide (16) and a radius of the generated enveloping curve has a center which is the same as a radius of the tappet guide (16), and in the area of transition (31), the rotation-symmetrical roller pin (25) has a common diameter with the exterior wall surface of the slide apron (23) of the roller tappet (15) and slides together with the slide apron in the roller tappet guide (16) of the housing bore (2).

2. The fuel injection pump as defined by claim 1, in which the casing surface of the roller pin (25) is bronzed.

3. The fuel injection pump as defined by claim 1, in which the roller (17) disposed on the roller pin (25) is secured to the roller pin by means of a press fitting.

* * * * *